US006460448B1

(12) United States Patent
Zangrando

(10) Patent No.: US 6,460,448 B1
(45) Date of Patent: Oct. 8, 2002

(54) AUTOMATED LOADER ASSIST FOR MORTARS

(75) Inventor: Roy A. Zangrando, Boonton, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 150 days.

(21) Appl. No.: 09/651,231

(22) Filed: Aug. 17, 2000

(51) Int. Cl.[7] ..... F41A 9/13

(52) U.S. Cl. ..... 89/45; 42/51; 89/1.3; 89/1.35; 89/40.02; 89/46; 89/37.05

(58) Field of Search ..... 42/51; 89/1.3, 89/1.35, 40.02, 37.05, 45, 46

(56) References Cited

U.S. PATENT DOCUMENTS

| | | | | |
|---|---|---|---|---|
| 4,489,639 | A | * | 12/1984 | Winkler et al. |
| 4,494,441 | A | * | 1/1985 | Magnuson |
| 4,669,357 | A | * | 6/1987 | von Laar et al. |
| 4,982,646 | A | * | 1/1991 | Machmer |
| 5,050,479 | A | * | 9/1991 | Heintz et al. |
| 5,526,730 | A | * | 6/1996 | Zangrando |
| 6,095,026 | A | * | 8/2000 | Poussard et al. |

FOREIGN PATENT DOCUMENTS

| | | | |
|---|---|---|---|
| EP | 000538138 A | * | 4/1993 |
| EP | 0890817 A1 | * | 1/1999 |

* cited by examiner

*Primary Examiner*—Michael J. Carone
*Assistant Examiner*—John Richardson
(74) *Attorney, Agent, or Firm*—John F. Moran; Michael C. Sachs

(57) ABSTRACT

The loader assist for mortars allows for the automated loading of ammunition through the muzzle. The invention assists soldiers by transporting the shell into the muzzle from a lower position near the base of the mortar tube thus reducing exposure to enfilade enemy fire and the effects of muzzle blast. The loader assist comprises a frame surrounding the mortar and attached thereto. The frame is supported on pivots mounted to a turntable such that both the invention and mortar move as a unit. A lift device is positioned at the center of the frame and parallel to the mortar axis. A carriage comprising a transfer device is positioned on top of said frame. Said elevator is comprised of two linear actuators which are positioned opposite each other, allowing the jaws on each shuttle to act in pairs with the respective jaws on the other, to grip the shell in two places. An actuator lifts the shell above the frame to hand it off to the transfer assembly, said shell displacing the elevator jaws until they fully engage and capture the shell, whereupon the lift actuator retracts to its starting position. The transfer assembly shuttles then raise the shell beyond the muzzle, translates it to the axis of the mortar, and inserts it into the tube. When the fins of the mortar are fully inserted in the mortar, the cam followers engage the cams. As the downward gravity travel of the shell continues, the contour of the cam causes the jaws to begin disengaging the shell in time for the jaws to clear the end of the mortar. As both jaws disengage, the shell falls under the influence of gravity.

6 Claims, 9 Drawing Sheets

AUTOMATED LOADER ASSIST FOR MORTARS

U.S. GOVERNMENT INTEREST

The invention described herein may be manufactured, used, or licensed by or for the U.S. Government for U.S. Government purposes.

BACKGROUND OF THE INVENTION

I. Field of Invention

This invention relates in general to ammunition handling for muzzle loaded mortars and, in particular, to automated assistance for loading ammunition into a mortar through the muzzle.

II. Background of the Invention

Mortars are muzzle loading cannons used to fire shells at short range and high angular elevation. They are loaded by manually dropping a shell down the barrel of the muzzle, and fire immediately when the shell impacts a fixed firing pin located at the bottom of the bore.

Mortars are typically emplaced on the ground in defilade but are also integrated into vehicles. In either case, the loading procedure exposes the soldier to enfilade fire. This invention assists the soldier by transporting the shell into the muzzle from a lower position near the base of the cannon thus reducing such exposure. It further reduces a soldier's exposure to the effects of the muzzle blast.

Accordingly, it is an object of this invention to provide a power assisted shell loader for mortars which minimizes the operator's exposure to blast and enemy fire.

Still another object of this invention is to load a shell into the mortar at any angle of elevation that the mortar is expected to fire.

Another object is to provide a device that is compatible with currently fielded mortars.

An additional object is to provide a simple, low cost device having low power consumption.

Finally, another object of the invention is to provide a device having a design that can be easily modified to achieve further automation by the addition of a magazine to store and issue shells to the loader device.

SUMMARY OF INVENTION

It has now been discovered that the above and other objects of the present invention may be accomplished in the following manner.

Specifically, there is provided a loader assist comprising a frame surrounding the mortar and attached thereto. The said frame being supported on pivots mounted to a turntable such that both the invention and mortar move as one, through azimuth and elevation. A lift device, comprised of a linear actuator to provide motion, a lift bracket, which engages the base of the shell, and guides to provide lateral support, is positioned at the center of the frame and parallel to the mortar axis. A carriage comprising a transfer device is positioned on top of said frame, perpendicular to the mortar axis, and movable on ways, from the axis of said lift, to the axis of the mortar. Said elevator is comprised of two linear actuators, each having a shuttle with two moveable jaws, spring biased downward, and moveable beyond the muzzle of the mortar. Said actuators are positioned opposite each other such that the jaws on each shuttle can act in pairs, with the respective jaws on the other, to grip the shell in two places. Each jaw has a cam follower, biased by a cam mounted to its respective actuator, and moveable to engage or disengage said follower. Said cams are biased to engage said followers when the carriage is positioned at the mortar, and oppositely biased to disengage the followers when the carriage approaches the lift position. A control device sequences the motion of all actuators.

To load and fire the mortar, a shell is placed in the guides of the lift actuator. A firing switch, conveniently placed, is actuated to initiate the action. Said actuator lifts the shell above the frame to hand it off to the transfer assembly, said shell displacing the elevator jaws until they fully engage and capture the shell, whereupon the lift actuator retracts to its starting position. The transfer assembly shuttles then raise the shell beyond the muzzle, translate it to the axis of the mortar, and insert it into the tube. During the downward insertion motion, the cam followers on the jaws engage the cam surfaces, sequently lifting each jaw as it approaches the muzzle thereby providing full support for the shell until it rides freely in the bore of the mortar. As the elevator shuttles reach their end of travel, the carriage moves back to the lift actuator, disengaging the cams and allowing the jaws to drop to their lowered position, whereupon the cycle may be repeated with another shell.

BRIEF DESCRIPTION OF DRAWINGS

For a full understanding of the nature and objects of the invention, reference may be had to the following detailed description taken in conjunction with the accompanying drawings, in which.

DETAILED DESCRIPTION OF THE PREFERRED EMBODIMENTS

Figure 1:
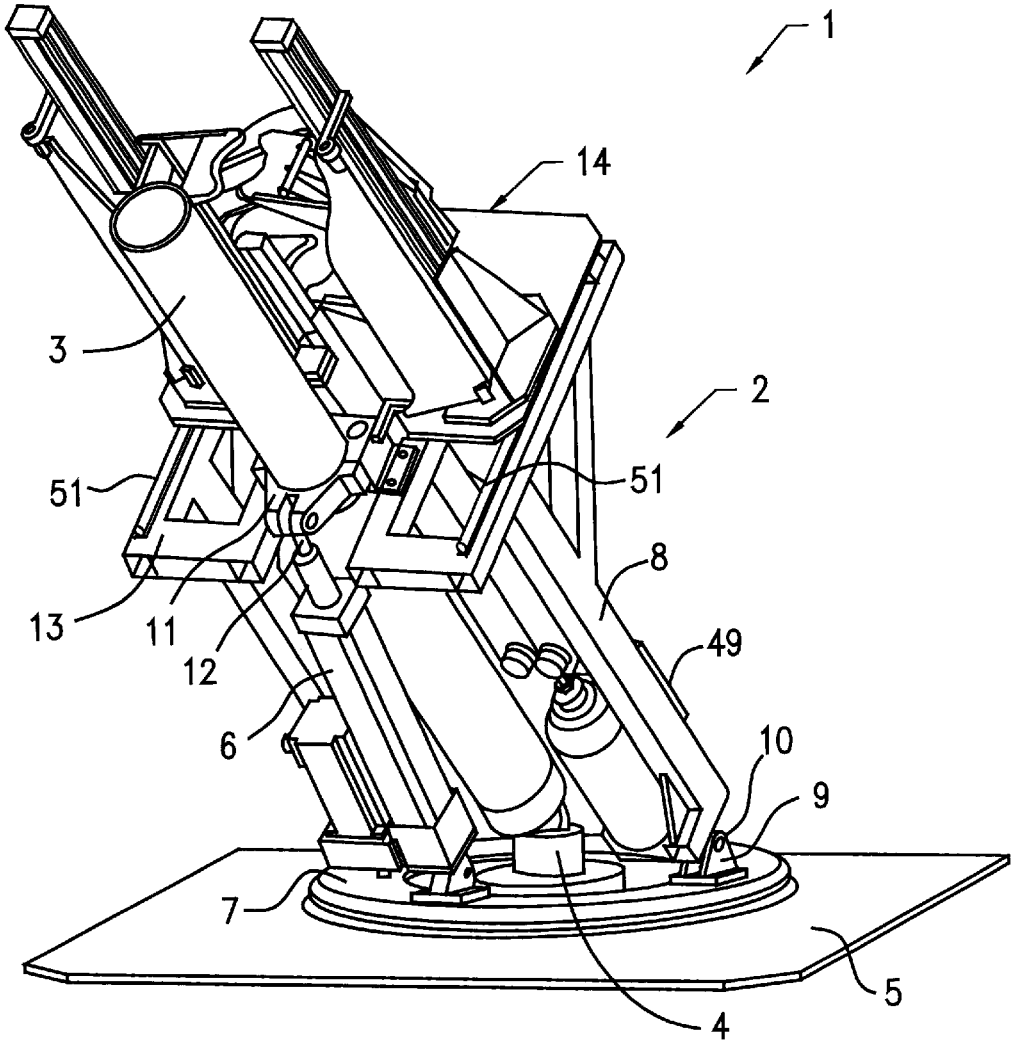
FIG. 1 is a pictorial view of an exemplary mortar having an automated mortar assist constructed in accordance with the present invention.

FIG. 1 shows a typical automated mortar system 1 employing the subject invention 2. A mortar 3, typical of the type to which the subject invention will be applied, is supported and moveable in a socket 4, attached to base 5, and pointed by means of elevating device 6 attached to turntable 7, also mounted to said base 5. Accordingly, a framework 8, of the subject invention, is secured to said turntable 7, by trunnion pins 10 through brackets 9. Said framework 8, is free to pivot in elevation on said pins 10 which are positioned axially coincident with the elevating axis of mortar 3 at socket 4. A tube damp 11, connected to elevating device 6, by pin 12, secures mortar 3 to the frame 8. Said clamp 11, is positioned on the top surface 13, of frame 8, such that said top surface 13 is perpendicular to the axis of the mortar 3. Thus secured, both mortar 3 and frame 8 move with fixed relationship in azimuth and elevation as determined by turntable 7, and elevating device 6.

Figure 2:
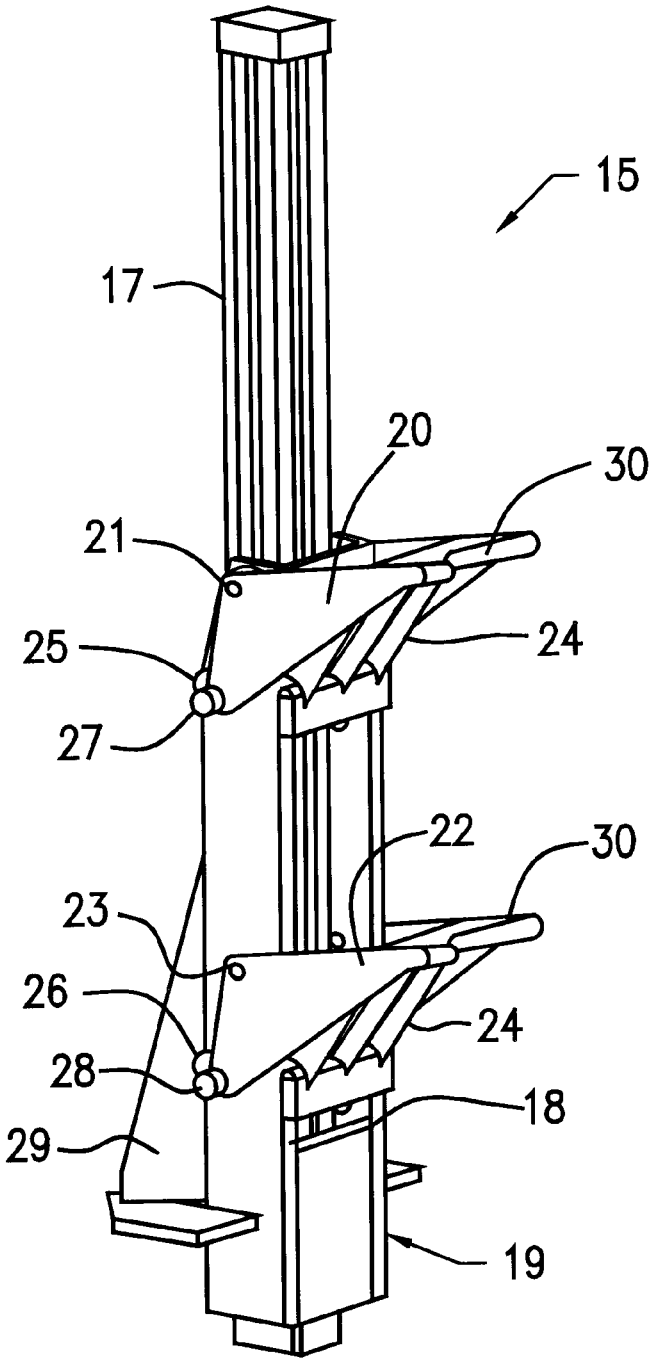
FIG. 2 is a pictorial view of the elevating assembly showing means to grip the shell.
Figure 3:
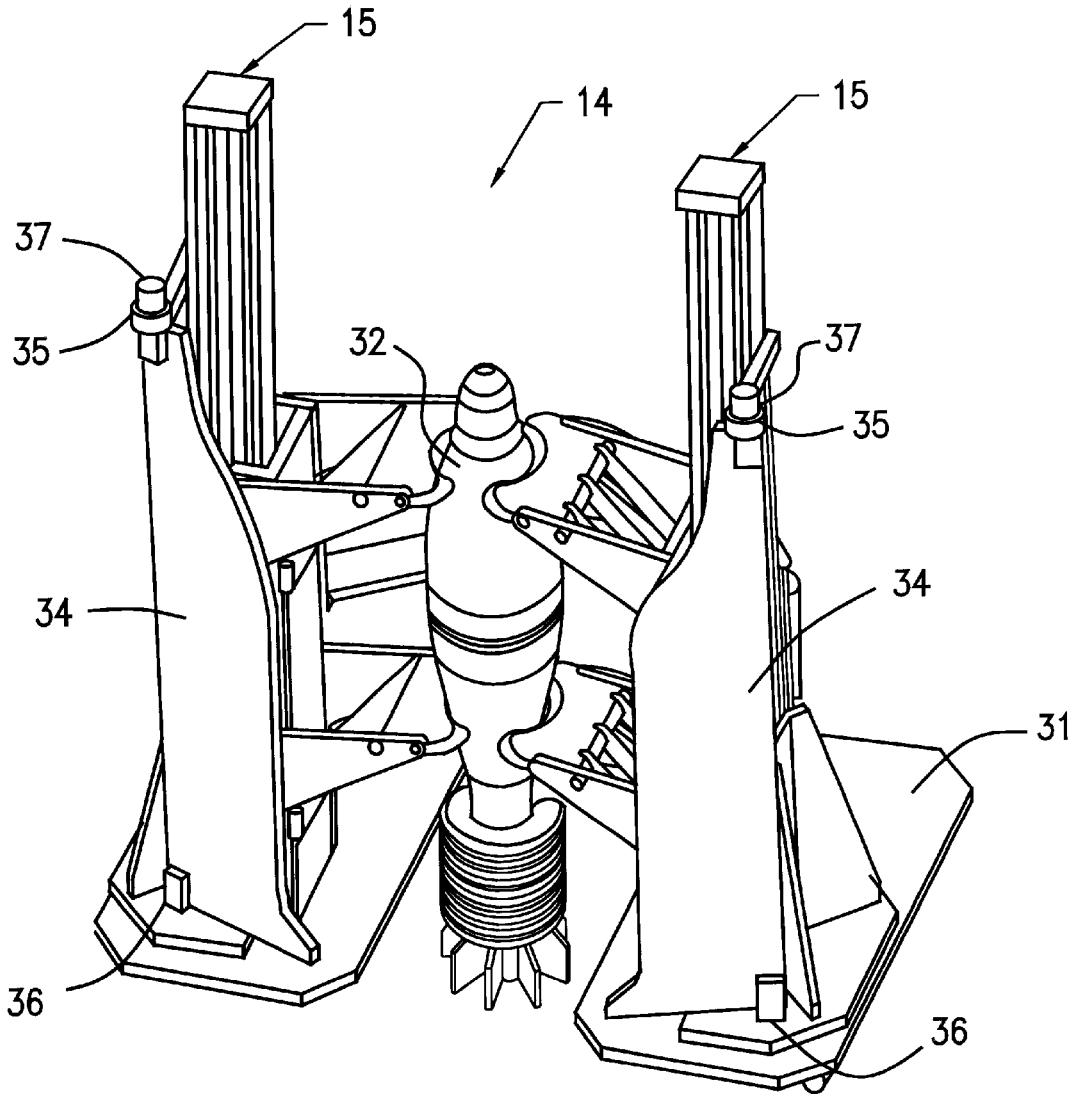
FIG. 3 is a pictorial view of the transfer assembly retaining a mortar shell.
Figure 4A:
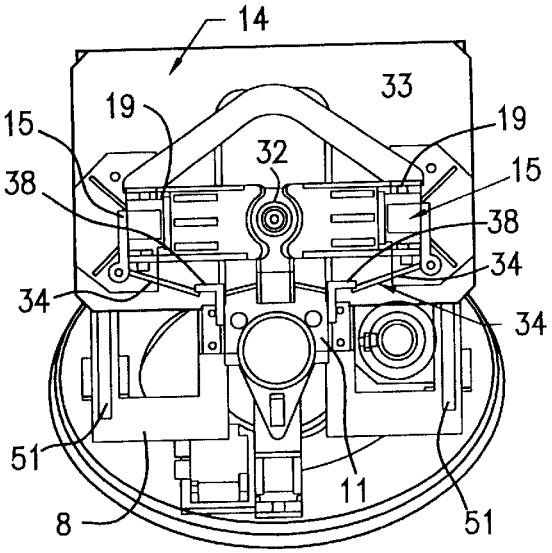
FIGS. 4*a* and 4*b* are two top auxiliary views of the invention showing alternate positions of the transfer assembly and respective cam positions.
Figure 4B:
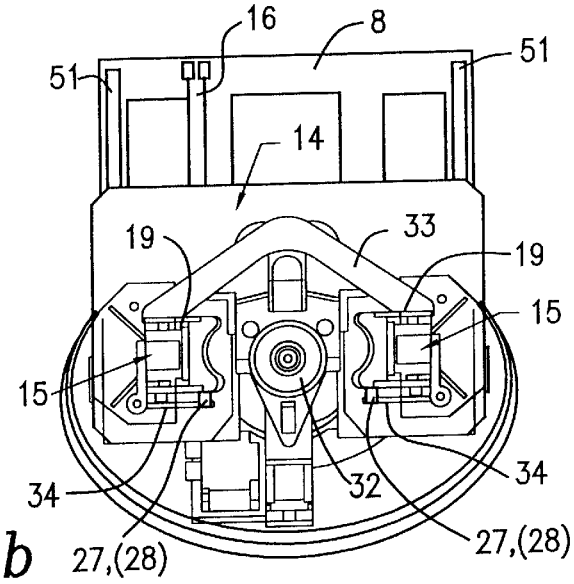

In FIGS. 1, 2, 3 and 4*a*, 4*b*, and in particular to FIGS. 1 and 4*a*, 4*b*, a transfer assembly 14 is slidable on rails 51, along the top of frame 8. Said transfer assembly 14, is movable from the position shown in FIGS. 1 and 4*a* (hereinafter referred to as the, "starting position"), to a position adjacent to the mortar 3, as shown in FIG. 4*b*. Said motion is accomplished by a double acting pneumatic cylinder 16, connected between the transfer assembly 14, and the frame 8. Turning now to FIG. 2, there is shown generally at 15, an elevating assembly comprised of a double acting rodless pneumatic cylinder 17, having a moveable slide 18, which is free to slide along the length of said cylinder 17, when biased by gas pressure in either direction. A shuttle 19, affixed to said slide 18, and moveable therewith, is comprised of an upper jaw 20, rotatable on pin 21, and similar lower jaw 22, rotatable on pin 23. Both jaws 20 and 22 are biased downward, by springs 24, against stops 25 and 26 respectively as shown in FIG. 2. Cam followers 27, 28 provide means to bias said jaws 20, 22, in direction opposite the bias of springs 24. Cutouts 30 at the ends of jaws 20, 23, are formed to be compatible with diameters of the mortar shell at the intended grip points. A mounting bracket 29 on cylinder 17 is provided to position and secure two opposing elevating assemblies 15 on carriage 31, so spaced to grip shell 32, thus providing both vertical and lateral support to said shell 32, as shown in FIG. 3. A bridge 33, shown in FIG. 4, rigidly joins the shuttles 19, to assure synchronized motion. Each elevating assembly 15, has a cam 34, moveable on pivots 35 and 36, and biased by spring 37, to the position shown in FIG. 4*b*, where they will engage cam followers 27 and 28, to provide the cam follower 27, 28, bias heretofore discussed. When the transfer assembly 14 is positioned in the starting position, as shown in FIG. 4*a*, tabs 38, on clamp 11, engage said cams 34, pivoting them out of engagement with cam followers 27, 28. FIG. 3 shows said cams 34 disengaged. A more detailed discussion of the related interactions between said jaws 20 and 22, shell 32, and cam 34, appears below.

Figure 5:
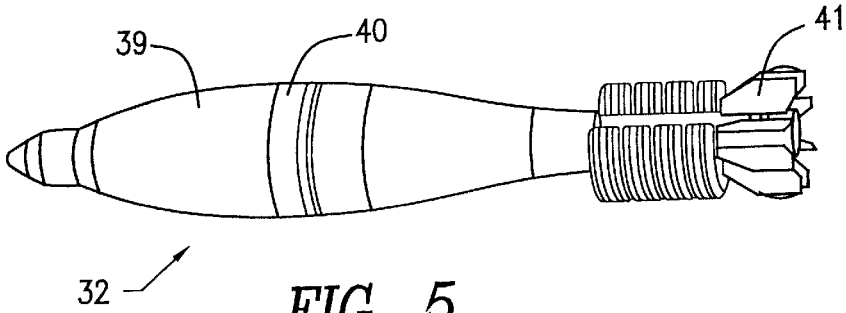
FIG. 5 is a pictorial view of an exemplary mortar shell referencing features relevant to the invention.

FIG. 5 depicts a typical mortar shell 32 which may be handled by the invention, showing the main body 39, bourrelet 40, and fins 41. The bourrelet 40, and outer edges of the fins 39, ride in the bore of the mortar 3 to guide the shell 32.

Figure 6:
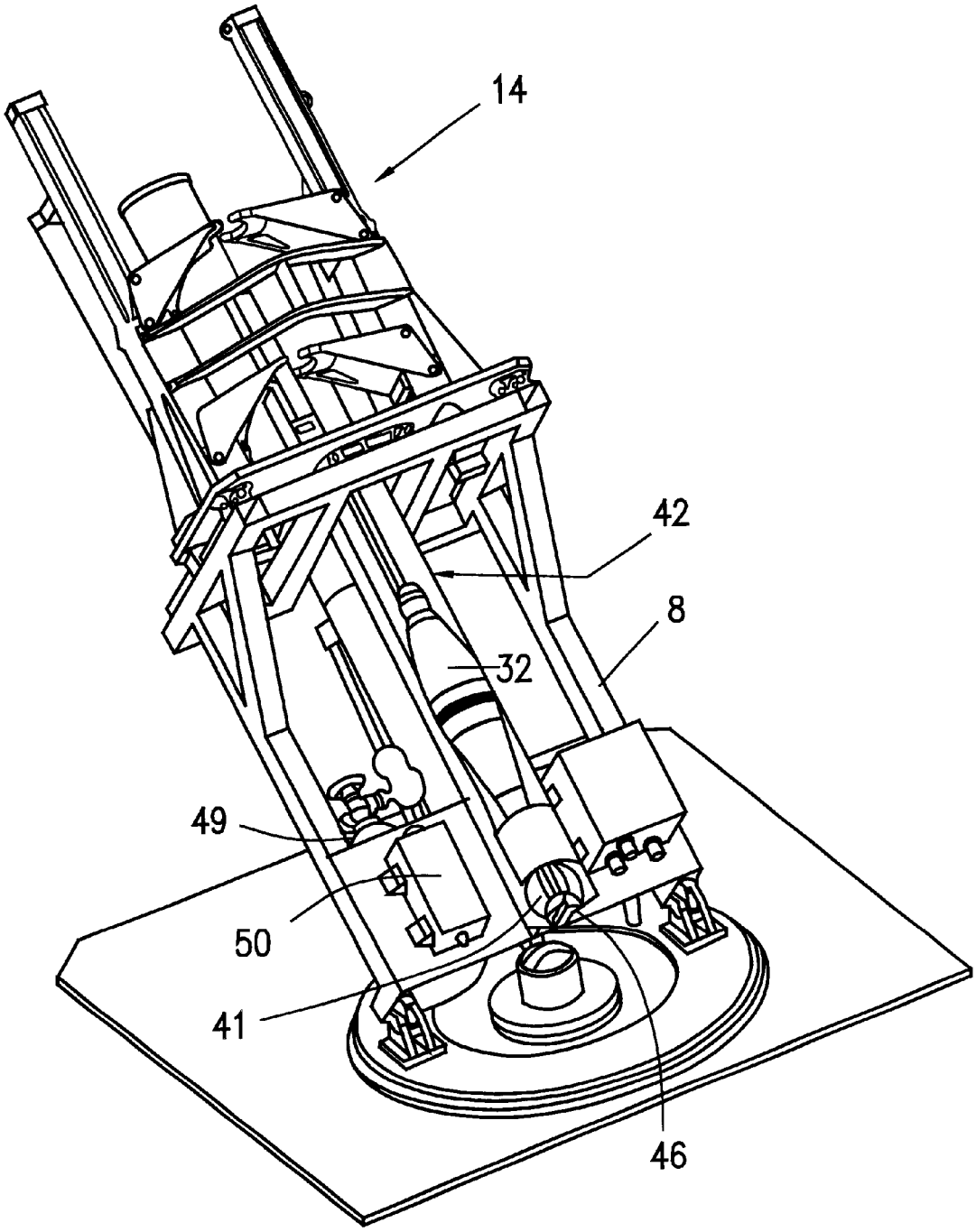
FIG. 6 is a pictorial view of the invention showing features not visible in FIG. 1, and a typical mortar shell in position for loading.
Figure 7:
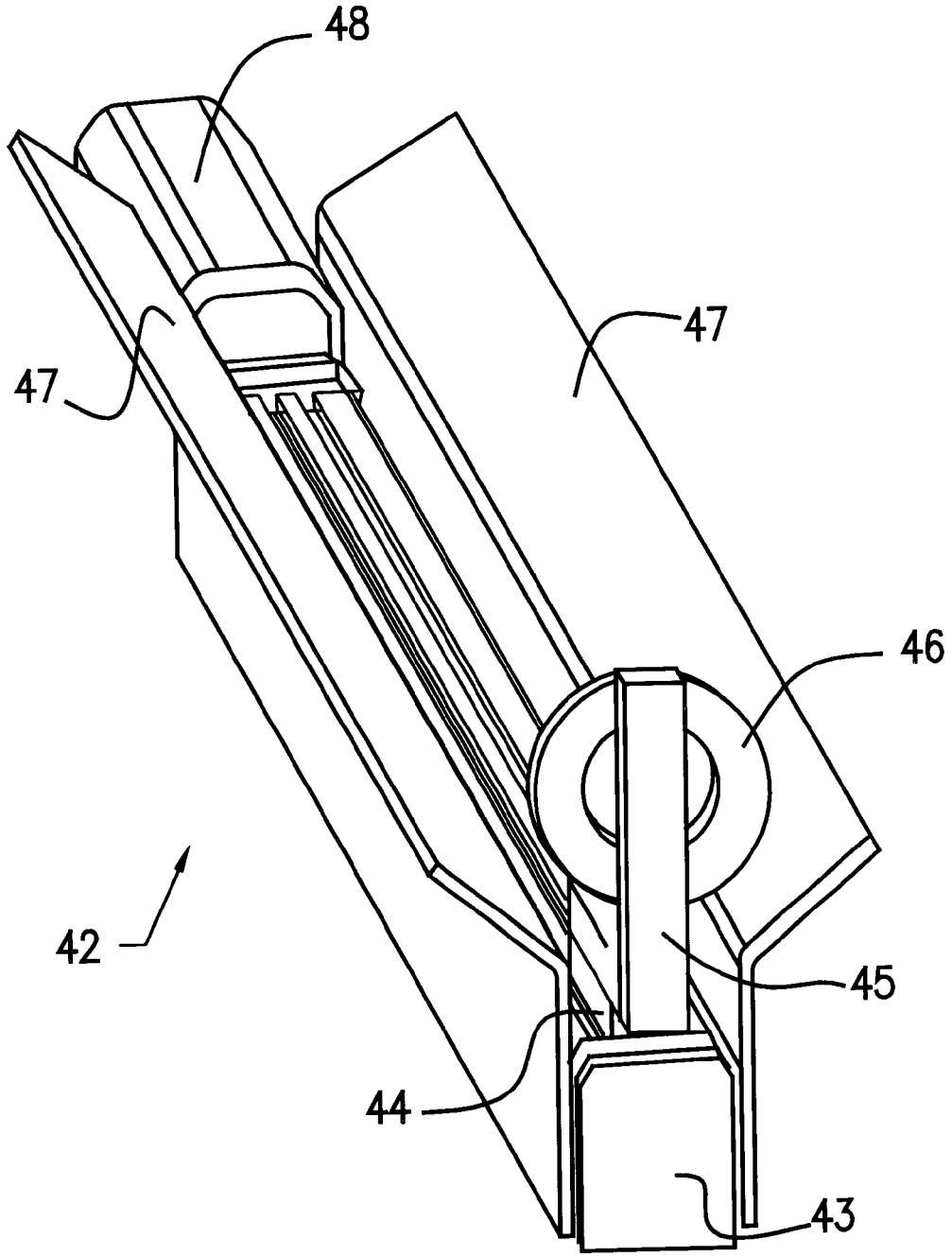
FIG. 7 is a pictorial view of the lifter assembly showing means to support and guide the shell.

Turning now to FIGS. 4, 5, 6, and 7, and particularly to FIG. 6, there is a lift assembly 42 attached to the center of frame 8. In FIG. 7 said lift assembly 42, is comprised of a double acting, rodless pneumatic cylinder 43, having a moveable slide 44, which is free to slide along the length of said cylinder 43, when biased by gas pressure in either direction. A lift bracket 45, affixed to said slide 44, and moveable therewith, has a centering ring 46, tapered to fit within the fins 41, of shell 32 as shown in FIG. 6. A pair of guides 47, affixed to the sides of cylinder 43, will support the shell 32, at its bourrelet 40, both vertically and laterally, when said shell 32 is so placed as shown in FIG. 6. Another guide 48, affixed to the upper end of said cylinder 43, of such width to fit between the lower jaws 22, provides similar support, but only vertically. Said guides 47, 48 are both so placed to positions aid shell with its centerline coincident with that of ring 46. Said lift assembly 42 is positioned such that a shell 32, placed therein, will be axially aligned with jaws 20 and 22 when the transfer assembly 14 is at its starting position.

Returning to FIGS. 1 and 6, a tank 49, stores compressed gas as a power source for the pneumatic cylinders discussed above, A pneumatic or electric control system 50, may be used to provide the proper sequencing.

Operation

Figure 8A:
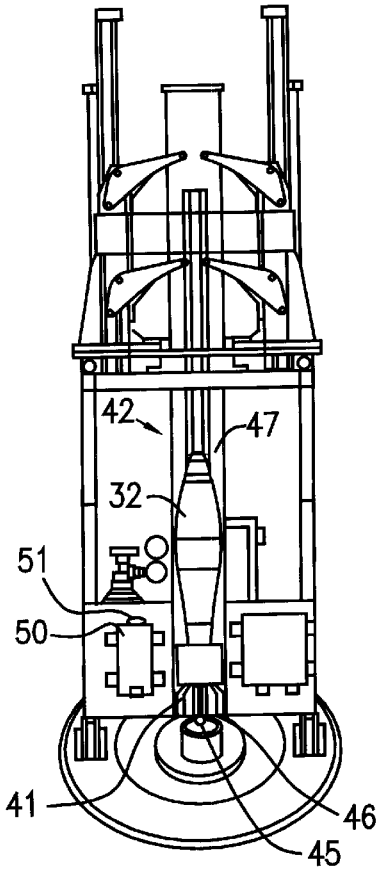
FIGS. 8*a*, 8*b*, 8*c* are three rear auxiliary views of the invention showing the sequential operation of raising the shell to the muzzle.
Figure 8B:
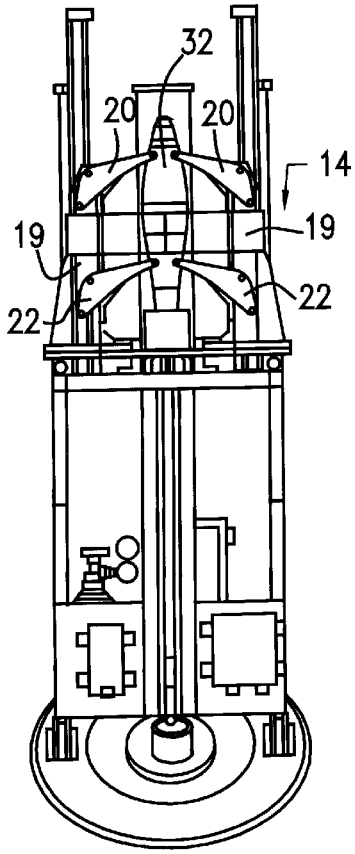
Figure 8C:
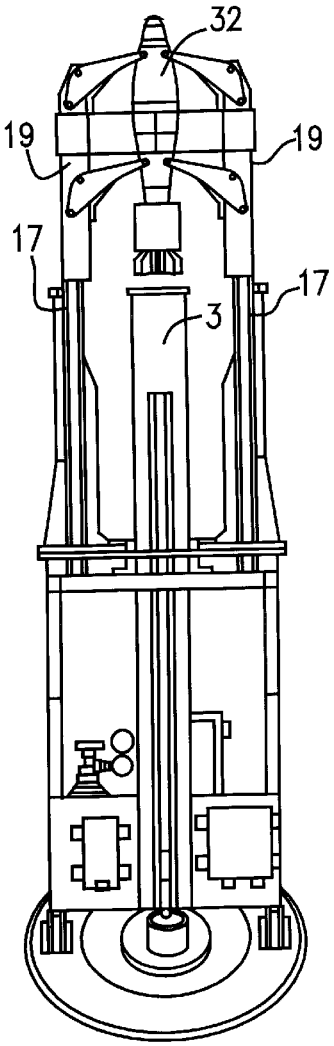
Figure 9A:
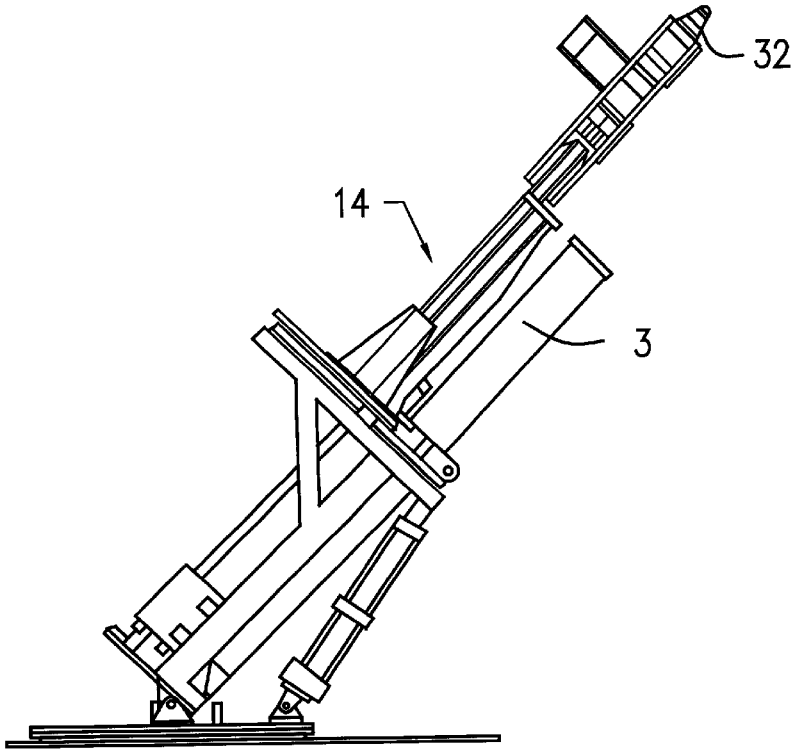
FIGS. 9*a*, 9*b* are two side views of the invention showing alternate positions of the transfer assembly.
Figure 9B:
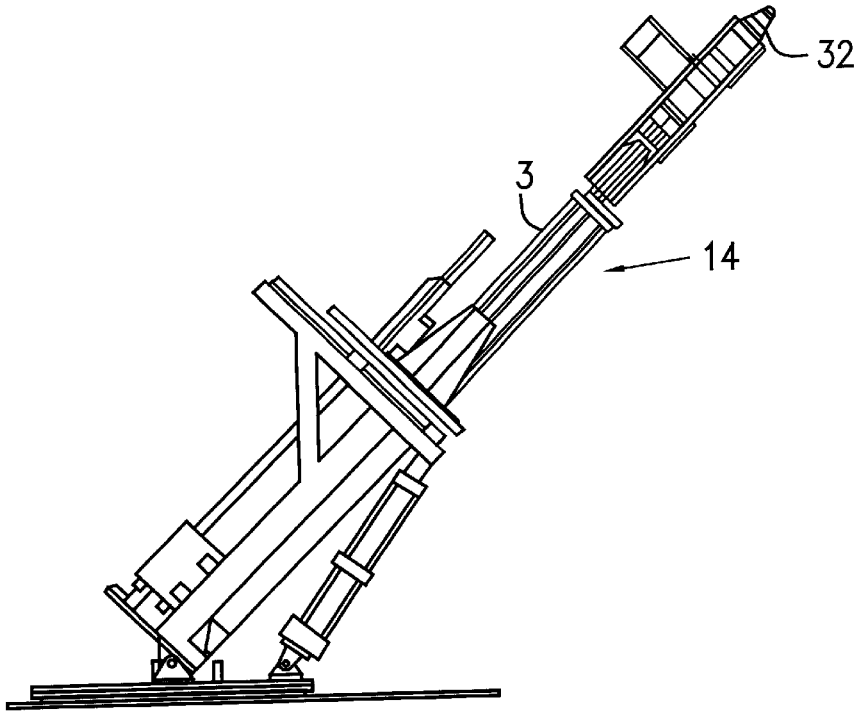

The functional operation of the subject invention is described below with reference taken to FIGS. 4, 7, 8, 9, and 10. FIG. 8*a* shows a shell 32 placed on the guides 47 of lift assembly 42 with its fins 41 resting over the centering ring 46 as shown in FIG. 8*a*. A start button 51 on control 50 is actuated to begin the sequence whereupon gas pressure is applied to cylinder 43, causing the shell to move upward, sliding along said guides 47. As said motion continues, the shell 32 passes between the jaws 22 of shuttles 19, displacing said jaws 22 as they pass over the larger portion of shell 32. At such time, said shell 32 has moved beyond the extent of guides 47, and continues by sliding along guide 48, with lateral support being provided by the spring biased jaws 22. Lift 42 continues to slide the shell 32 upward until it engages jaws 20 as shown in FIG. 8*b*. A slight additional movement assures that the lower jaws 22 will have clearance to drop back down to their starting position. Gas pressure is now applied to retract the lifter 45, to its starting position, whereupon the shell 32 falls back into jaws 22 leaving the shell 32 suspended within the transfer assembly 14. Gas then applied to cylinders 17, causes the shuttles 19, to move upward, lifting said shell 32 further along its previous path, to a point above the muzzle of mortar 3, as shown in FIG. 8*c*. Reference to FIGS. 4*a* and 9*a*, shows a side view of the transfer assembly 14, at the position last described. Gas now applied to cylinder 16, moves the transfer assembly 14 forward, aligning the shell 32 with the mortar 3, as shown in FIGS. 4*b* and 9*b*. As this motion proceeds, cams 34 cease to be influenced by tabs 38, and are biased to alignment with cam followers 27 and 28, as shown in FIG. 4*b*. Gas now applied to cylinders 15, opposite to that previously applied, begins downward movement of the shuttles to insert shell 32 into the mortar 3.

Figure 10A:
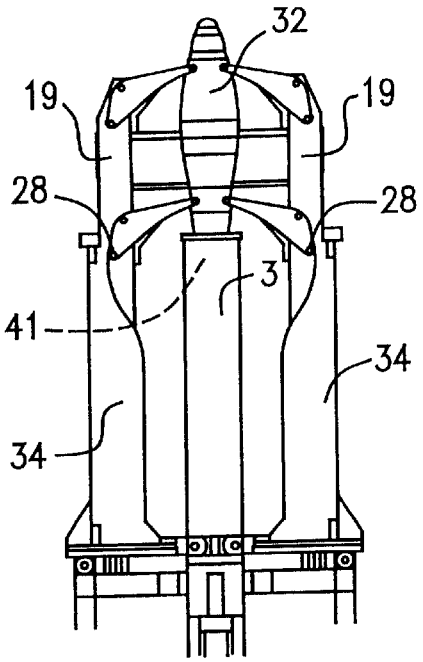
FIGS. 10*a*, 10*b*, 10*c*, 10*d* are four front auxiliary views of the invention showing the sequential operation of inserting the shell into the mortar. Pneumatic hoses and connections are not shown in any of the drawings.
Figure 10B:
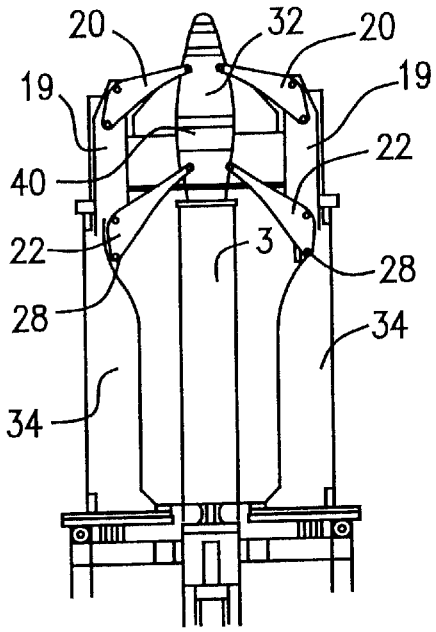
Figure 10C:
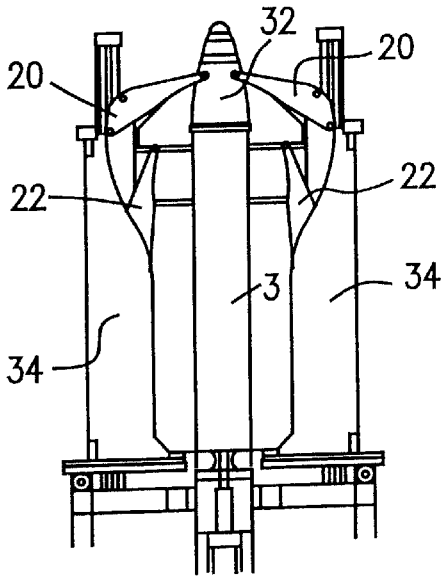
Figure 10D:
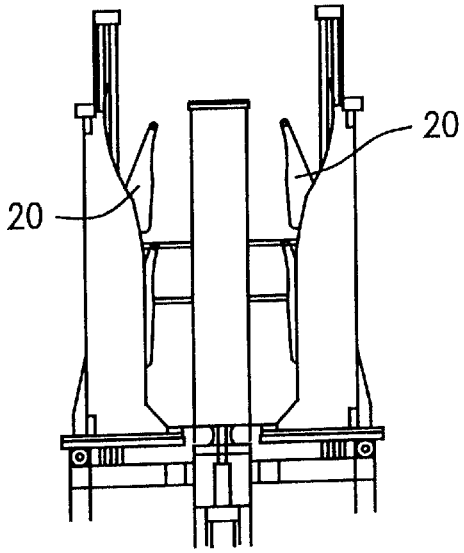

Referring now to FIGS. 10*a*, *b*, *c*, *d*, the shuffles 19, are shown at several points of the insertion process. FIG. 10*a* shows shell 32 with its fins 41 fully inserted in mortar 3, at which time, cam followers 28 are beginning to engage cams 34. As the downward travel continues, the contour of cam 34 causes the lower jaws 22 to begin disengaging the shell 32 in time for said jaws 22 to clear the end of the mortar 3, as shown in FIG. 10*b*. The shell 32 is now guided at its lower end by the fins 41, riding in the bore of mortar 3, and at is upper end by the upper jaws 20. Since vertical support for the shell 32, heretofore provided by the lower jaws 22, is no longer present, said shell 32 will begin to fall under the influence of gravity. It is important therefore, that the downward velocity of the shuttles 19 be sufficient to maintain contact between their upper jaws 20, and the shell 32, until the bourrelet 40, of said shell 32, has entered the mortar 3. FIG. 10*c* shows the shell 32 fully engaged in the bore of mortar 3, where said shell 32 is free to continue downward unaided by the invention. At this time, the lower jaws 22 have fully retracted, and the upper jaws 20 are beginning to engage the cams 23. Completion of the downward motion of the shuttle causes the upper jaws 20 to fully retract as shown in FIG. 10*d*.

Returning now to FIGS. 2 and 4, and in particular to FIGS. 4*a,* 4*b,* actuation of the cylinder 16 moves the transfer assembly 14, from its current position, as shown in FIG. 4*b,* back to the starting position (FIG. 4*a*). During this travel, the cams 34 contact tabs 38 causing said cams 34 to pivot outward and disengage from the cam followers 27, 28. Both upper and lower jaws 20, 22, now unrestrained, are biased downward by springs 24, to their starting positions against stops 25, 26 respectively thus completing the loading cycle.

Thus, it is apparent that in accordance with the present invention, a functional design that fully satisfies the objectives, aims and advantages is set forth above. While the invention has been described in conjunction with a specific embodiment, it is evident that many alternatives, modifications and variations will become evident to those skilled in the act in light of the foregoing description. Accordingly, it is intended that the present invention embrace all such alterations, modifications, and variations as fall within the spirit and broad scope of the appended claims.

What is claimed is:

1. An ammunition loading apparatus for use in automatically loading a shell into a mortar through a muzzle, comprising:

a frame surrounding the mortar and attached thereto moving as one, through azimuth and elevation, having:

a lift that lifts the shell which is positioned at a center of the frame, at a starting position along substantially a lift axis that is parallel to a mortar axis, to a desired position, for transfer into a carriage of the frame;

the carriage comprising a transfer assembly positioned on top of the frame, and moveable on ways perpendicularly to the mortar axis, from the lift axis to the mortar axis;

wherein the transfer assembly is comprised of two linear actuators each having a shuttle with two moveable jaws, spring biased downward, and moveable beyond a mortar muzzle;

wherein the two linear actuators are generally positioned opposite each other so that the two moveable jaws of each shuttle act in pairs to engage and capture the shell in two places until the shell is released in a mortar tube;

wherein the transfer assembly shuttles then raises the shell beyond the mortar muzzle, translating the shell to the mortar axis, and inserting shell into the tube;

wherein the transfer assembly releases the shell to ride freely in the mortar tube under gravity; and wherein the transfer assembly returns to the starting position; and a control device to sequence a motion of the carriage.

2. The ammunition loading apparatus of claim 1, wherein the frame is secured to the mortar with a clamp and is supported on pivots mounted to a turntable so that the frame and mortar move as one, through azimuth and elevation.

3. The ammunition loading apparatus of claim 1, wherein the lift comprises:

a linear actuator to provide motion further comprised of a double acting, rodless pneumatic cylinder having a moveable slide;

a lift bracket affixed to the slide to engage a base of the shell;

guides affixed to the sides of the cylinder to provide vertical and lateral support to the shell at its bourrelet; and a second guide affixed to an upper end of cylinder to provide vertical support.

4. The ammunition loading apparatus of claim 1, wherein the transfer assembly, comprises:

a bridge to rigidly join the linear actuators to assure synchronized motion;

rails to allow the carriage to slide along the top of the frame to translate the carriage to the mortar axis to reach the starting position for releasing the mortar down a muzzle of the mortar tube.

5. The ammunition loading apparatus of claim 4, wherein each of the two linear actuators comprises:

a double acting rodless pneumatic cylinder with a moveable slide;

a shuttle affixed to the slide being further comprised of:

an upper rotable jaw with compatible end points biased downward by springs so spaced to grip the mortar shell above the bourrelet in accordance with the movement of the said shuttle a lower rotable jaw with compatible end points based downward by springs to grip the mortar shell above the fins but below a bourrelet in accordance with the movement of the shuttle.

6. The ammunition loading apparatus of claim 5, further comprising cam followers that bias the jaws in a direction opposite a downward bias of the springs of the jaws.

* * * * *